United States Patent [19]

Wilensky

[11] 4,442,675

[45] Apr. 17, 1984

[54] METHOD FOR THERMODYNAMIC CYCLE

[75] Inventor: Joseph Wilensky, Houston, Tex.

[73] Assignees: Soma Kurtis; Jack Sloan, both of Denver, Colo.

[21] Appl. No.: 262,783

[22] Filed: May 11, 1981

[51] Int. Cl.[3] ..... F01K 19/10

[52] U.S. Cl. ..... 60/654; 60/688

[58] Field of Search ..... 60/654, 685, 688, 689

[56] References Cited

U.S. PATENT DOCUMENTS

| | | | |
|---|---|---|---|
| 3,861,151 | 1/1975 | Hosokawa | 60/689 |
| 4,051,680 | 10/1977 | Hall | 60/689 |
| 4,089,177 | 5/1978 | Olofsson | 60/688 |

*Primary Examiner*—Allen M. Ostrager
*Assistant Examiner*—Stephen F. Husar
*Attorney, Agent, or Firm*—Jack C. Sloan

[57] ABSTRACT

A working fluid in the gaseous state at some initial temperature and pressure is expanded polytropically to a resulting exhaust fluid (vapor and liquid) having some lower pressure at some lower temperature in order to produce useful work. The exhaust fluid is then, in a manner approaching constant enthalpy, compressed to the working fluid's nominal original high pressure. Thereafter, the fluid undergoes constant pressure heating to restore its initial state. Of the several methods described for achieving isenthalpic compression, the preferred method uses an isenthalpic compression apparatus which educts the exhaust fluid vapors into a throat located between a motive fluid inlet nozzle and a wider recompression outlet. After eduction, and entrainment into the motive fluid, the exhaust vapors are recompressed by the deceleration produced at the recompression outlet. Thereafter the working fluid and motive fluid are separated. The motive fluid at elevated pressure consists of liquid in quantities sufficient to accomplish gas recompression with surplus quantities being returned to reservoir storage.

8 Claims, 6 Drawing Figures

W
237
235
236
232
234
233
231
A
B
229
230
EXISTING PROCESS HEATER
$Q_2$
$Q_1$
239
AVAILABLE REFRIGERATION
238
228
227
240
243
EXISTING RECEIVER
216
226
217
$Q_5$
214
215
213
C
WATER
218
220
219
NET PROPANE
206
211
205
WATER
241
222
223
224
212
207
EXISTING DEPROPANIZER W/ANCILLARIES
208
$Q_4$
221
242
NET GASOLINE
210
204
203
202
$Q_3$
STEAM OR EXCHANGE
209
201
225
FROM PROCESS

METHOD FOR THERMODYNAMIC CYCLE

BACKGROUND OF THE INVENTION

1. Field of The Invention

This invention relates generally to obtaining useful work from the polytropic expansion of working fluids by reversible adiabatic expansion. More particularly it is concerned with methods of restoring such working fluids to their original thermodynamic conditions by isenthalpic compression followed by heating, preferably by the use of ambient energy sources.

2. Description of the Prior Art

Useful work production by heating and vaporization of liquids, including cryogenic liquids under pressure, and thereafter expansion to exhaust vapors as well known. U.S. Pat. Nos. 3,451,342 and 3,987,632 well represent this art. However, some of these systems, particularly those designed to employ ambient heat sources, assume a continuous supply of cryogenic fluid from outside sources and are not concerned with recompressing and condensing their exhaust vapors back to the cryogenic liquid state in order to achieve a "closed" thermodynamic cycle. Those prior art systems, such as the one taught in U.S. Pat. No. 3,287,901 that have addressed the problem of closing a thermodynamic cycle are generally characterized by the placement of expansion turbines, pumps, engines, coils, etc., as well as the cryogenic liquid reservoir itself, all inside large and sometimes elaborately insulated cryogenic chambers.

These cooling chamber arrangements have certain practical, as well as theoretical limitations. Practical limitations exist because the cryogenic environments within the cooling chambers are inherently hostile to mechanical equipment, while any heat created by the equipment's mechanical movement is an anathema to the maintenance of the cryogenic conditions needed in the chamber to condense the exhaust vapors. This dilemma represents the practical aspect of the overall problem associated with the introduction of heat into these cooling chambers. There are important theoretical limitations as well; the most important of which is that a direct isentropic expansion from a vapor state to a state of total condensation implies a nearly perfect conversion of the working fluid's latent heat of vaporization, if any, to an amount of work output which would need to be reemployed to restore the working fluid to its original state, thus producing no net useful work. Such a perfect conversion has proven to be an extremely elusive goal and to the extent it cannot be achieved due to the original entropy of the working fluid at its original high pressure state, there must be provided another distinct step of direct heat removal from such chambers in order for the working fluid to arrive at a state of total condensation. That is to say, the latent heat of vaporization must go to some "heat sink" before total condensation becomes possible. Present practice acknowledges the difficulty of achieving direct isentropic expansion to total liquid by carefully providing heat sinks through which the latent heat of vaporization is removed in order to convert a vapor back to a saturated liquid. However, the removal of the latent heat at some low temperature implies both a lower limit of operation for the thermodynamic cycle and an irrevocable loss of the latent heat of vaporization. This invention differs from both forms of the prior art in that it does not attempt a direct isentropic expansion to a liquid nor a total condensation of the working fluid by means of a heat sink. Rather it is concerned with recompression of the working fluid along a path of isenthalpic compression in order to provide a closed thermodynamic cycle that has been freed of the heat sink limitations of the prior art so that the latent heat of vaporization need not be irrevocably discarded in order to repressure the working fluid.

SUMMARY OF THE INVENTION

An understanding of this invention is best achieved by first discussing certain theoretical considerations of the laws of thermodynamics and thereafter relating these considerations to the invention by means of thermodynamic charts, diagrams and supporting mathematical calculations. Finally, exemplary physical embodiments of the invention will be placed in various working environments to demonstrate just how useful results can be achieved. The theoretical discussion must start with the realization that in all attempts to obtain work from heat, the concept of mechanical force is indispensible. For such processes to be continuous, an assumed inexhaustible source of force can only be replaced by a source of force which when exhausted can be replenished. Within the confines of this disclosure the above statement implies the circulation of a fluid at high pressure and temperature, giving up work energy and exhausting it to low temperature and pressure. The total heat expanded may then be replaced in the high pressure fluid to complete the cycle. If all of these steps were to take place perfectly, i.e., without a gain in entropy, the relationship of heat to work conversion would become independent of path, devices, purposes and depend only on the thermodynamic states of the working fluid. The invariable result of any such energy cycle, if carried out perfectly would be the well known relationship:

$$(W/q)=(T_1-T_2)/T_1 \qquad \text{(equation 1)}$$

where:

W = Net work output q = Gross heat input $T_1$ = Thermodynamic absolute temperature attained after heat input $T_2$ = Thermodynamic absolute temperature attained after heat output $T_2$ in this relationship has often been called the "sink temperature" and described as a point of limitless heat capacity, so large as to be essentially unaffected by such heat disposal. This conclusion has been reached in view of the cycle as described in equation 1, being forced to discard heat at temperature $T_2$. That it must discard heat at a permanent unaffected lower temperature has set the lowest such available temperature as an impassable limitation, preventing the re-use of the heat thus discarded. Heretofore, the repressuring of the working fluid without the total expenditure of work output has only been accomplished at the irrevocable sacrifice of that portion of the total heat content of the fluid known as the latent heat of vaporization.

This invention has many aspects and applications but its most important and fundamental teaching is that the concept of a "heat sink" as the necessary interpretation of the lower temperature in the relationship $(W/q=(T_1-T_2)/T_1$ is not necessarily true, nor is its interpretation as a limitation. Even though it remains true that in the course of a single trip through a thermodynamic cycle, the total heat encompassed by the working fluid between the temperature extremes may produce only the net work available in equation 1, it is not necessarily true that the residual heat must be lost or discarded irrevocably. Through isenthalpic compression it may be maintained as a heat inventory to be recycled, implemented by additional heat, and re-used as a vehicle of kinetic motion by which an added portion of heat may be sequestered and employed to produce useful work at a high degree of efficiency.

The medium for accomplishing this is thus shown to be, in effect, a "work sink" (perhaps even better characterized as a "floating work sink", unassociated with any particular level of temperature) in which a circulating fluid gathers residual heat and restores direction to it as a pressure potentially available for production of useful work. Hence the process of deriving work from heat is no longer moored to a local ambient temperature as a heat sink. This permits the work derivation to be conducted at any point of convenience in the temperature spectrum. Consequently, equation 1 may now be contemplated in its true perspective; W/q, the conversion of heat to work on a single pass of a working fluid through a thermodynamic cycle approaches unity either as the high temperature gets very high or as the low temperature gets very low.

The above theoretical considerations can be clarified if they are also related to a thermodynamic chart such as the one depicted in FIG. 1 wherein the thermodynamic variable temperature T, in degrees Rankine is presented as the linear ordinate and entropy, S, in BTU/lb-degree Rankine, as the linear abscissa. Isobars connect paired values of the coordinates at equal pressure, P, in pounds per square inch absolute. Isenthalpic lines connect paired values of the coordinates at equal heat content, H, in BTU/lb. A heavier, dome-shaped, curved line ("phase envelope" or "vapor/liquid phase envelope") depicts the boundary condition of vapor/-liquid equilibrium, i.e., the borderline of a region ("vapor/liquid phase region") wherein the liquid and vapor phases may exist simultaneously and contiguously. Paired values of the coordinates enclosed below this boundary do not represent the values of the coordinates, but rather the algebraic combination of the properties of the liquid and vapor in their existing proportions at the phase envelope. The highest point, CP, on the phase envelope is termed the critical point, the value of the ordinate at this point the critical temperature, and the value of the isobar which is at that point tangent to the envelope, the critical pressure. At all points on the chart at temperatures greater than the critical temperature, the fluid is entirely in the gaseous state and noncondensible by any means unless cooled below that temperature. The region below this temperature enclosed by the axes and the left side of the phase envelope is entirely liquid. In the body of this region vapor may be created by combinations of finite amounts of heat and pressure and is termed "subcooled." At the phase envelope boundary, the liquid is termed "saturated" and any increase in temperature or decrease in pressure will be accompanied by some evaporation. The region below the critical temperature and to the right of the phase envelope consists entirely of vapor. In the body of this region finite amounts of reduction in temperature and/or increase in pressure may accomplish condensation. The vapor in this region is termed "superheated". At the phase envelope, the vapor is termed "saturated", such that any decrease in temperature, or increase in pressure will be accompanied by some condensation. Within the phase envelope itself there is a conceptualized region of mixed liquid and vapor phases. Here isobars are horizontal, i.e., parallel to the abscissa and connect points on the envelope of identical temperature and pressure which are termed either "saturation temperature and pressure" or "vapor/liquid equilibrium temperature and pressure." Quality, that is the proportions of vapor and liquid for the thermodynamic function within the envelope are entirely derived by linear interpolation of the values of the pure phases at saturation. It is also important to bear in mind that the thermodynamic energy function values, e.g., enthalpy and entropy, are determined by state and are independent of the path taken to reach that state.

Thus, such a temperature vs. entropy chart conveniently describes the thermodynamic states through which the cycle of this invention passes. To this end, a description of three states (also called "conditions" or "points") is essential. State A represents the point of highest pressure $P_1$ and temperature $T_1$ of the working fluid. State B represents the point at lowest temperature $T_2$ and pressure $P_2$. Here the working fluid could be called the exhaust vapor (or "low pressure working fluid"). State C represents the system nominal high pressure $P_3$ at an intermediate temperature $T_3$. State C could lie without the phase envelope or lie within it as shown in FIG. 1. Any given State B is connected to any given State C by a line of constant enthalpy as shown. Other points X, J, CP, B' and C' are also located for clarification of certain theoretical consideration of this invention hereinafter discussed.

For example, one such theoretical consideration is that State B may be anywhere on the chart where the working fluid is at least partially vaporized and its temperature is lower than the critical temperature. State B is conceptualized to include State B' which is at the same pressure but higher enthalpy than State B. Similarly State C is conceptualized to include State C' which is at the same pressure but higher enthalpy than State C. State C lies on the same line of constant enthalpy but at a higher pressure than State B', the path from B' to C' represents the path realized in attempting isenthalpic compression to the pressure of C from B', the actual enthalpy change from B' to C' reflecting the additional work needed to overcome mechanical imperfections and overcome the natural expansion tendency of the fluid. Point X for the purposes of this disclosure is a state along the saturated liquid boundary of the phase envelope. The specific location as shown in FIG. 1 is that the state of saturated liquid at the temperature and pressure of point B. Those skilled in the art will appreciate that the path from point B' to point C is accompanied by an equal change in energy to that which would be undergone by following the composite path from point B' to point X and thence from point X to point C. Furthermore, since B' and C are at equal enthalpy, for every drop of liquid condensed from exhaust fluid vapor the latent heat of vaporization released from the vapor portion from point B' to point X will be identically equal to the heat replacement required to restore that condensate from point X to point C. Furthermore, the characteristics of any working fluid are such that at successively lower exhaust fluid pressures, point C' departs progressively further from point C. A minimum pressure thus exists for points B and B' which forces the coincidence of point C' with point A. This would in effect cancel the advantages of the thermodynamic with cycle of this invention.

As indicated by current practice as well as by the three previously cited patents, the technologies for effecting the transition along the thermodynamic paths from State A to State B and from State C to State A are well known. The techniques employed to produce the transition of the working fluid from State B to State C constitute the fundamental aspects of this invention. Nonetheless the A to B and C to A paths have important interrelationships with this invention which should be clarified. Starting at State A, we have a working fluid at system high pressure and at whatever temperature that can be provided. This working fluid can expand through the infinite gradations from entirely free, unopposed liberation to the closely restricted, almost shutoff point of resistance to that expansion, such that only a differential tendency to expand exists. The former free expansion, not being called upon to overcome resistance retains virtually its entire energy content, is termed "isenthalpic," bears the label "irreversible," represents essentially horizontal movement of a point such as point A, and loses temperature only to the extent of the pressure-volume loss of the working fluid, (this phenomenon is known as Joule-Thompson expansion and can in actuality result in a rise in temperature if the change of the actual pressure-volume product is a gain. There is a point of reversal of this tendency that can be identified with any energy level of a working fluid. This is known as the Joule-Thompson inversion point which has been shown in FIG. 1 as point J for the specific line of constant enthalpy traversed in this isenthalpic compression). On the other hand, almost equal opposition requires the expanding gas to do considerable quantities of work to overcome the opposition. This work is obtained at the expense of internal energy and/or the pressure-volume potential. A drop in pressure due to the inhibited expansion will in this case be accompanied by a large temperature decrease. For a truly differential pressure gradient, this energy transfer yields the maximum work output of the thermodynamic transformation. Using only internal heat, a maximum is converted to work in a process labeled "reversible adiabatic" and characterized by no change in the property called "entropy," and thus is called "isentropic." Naturally, practical considerations, such as thermal inefficiency, friction, etc., preclude perfect reversibility. Perfect isentropic expansion would be depicted on the chart by the vertical movement from point A to point B. In reality, at the thermal efficiencies achieved, the path from A to B' is followed in the pressure and temperature drop and slightly less useful work output is realized at the higher enthalpy of point B'. This practical approach to isentropic expansion is often referred to as polytropic expansion.

This invention contemplates the employment of any and all expansion devices known to the art that suit the stages of expansion along this path from A to B'. Expansion through a turbine to produce shaft work is the most common example. Where applicable to certain of its aspects, this invention also contemplates the provision of expansion engines that cause the path from Point A to Point B' to enter the vapor/liquid phase region without causing damage to the machinery by "turbine rattling effects" etc. Care should also be taken to prevent point B from ever entering any region where the working fluid might be solidified. That is to say, the state conditions should never be permitted to go below the triple point of the working fluid. It should also be pointed out that the cryogenic methods known as Joule-Thompson free expansion processes or Joule-Thompson engine expansion processes are capable of producing extremes of low temperature, limited only by insulation efficiency. Thus, for purposes of initial start-up and/or subchilling of the working fluid in the path from B to C, use of such Joule-Thompson expansion systems may prove advantageous.

A beginning appreciation of the thermodynamic, mechanical and hence economic advantages of this invention can best be gained by comparing the B to A return path alternatives. If one were to recompress directly the working fluid, he would essentially retrace the path from point B to point A since the fluid in itself would require the restoration of all the work it had yielded in the isentropic expansion. If the path from point B to point X and then from point X to point A were followed the latent heat of vaporization would have to be discarded in reaching point X. Alternatively, this invention contemplates the introduction of a "detour" to provide as much as possible for the exhaust fluid to be liquefied to an incompressible state, but in any case to restore pressure to the working fluid without the temperature rise of polytropic compression. This is possible since raising the pressure of an incompressible liquid can be accomplished without doing work. The potential energy thus provided can be employed to provide an irreversible recompression of the gas portions of the exhaust fluid with partial further liquefaction to the initial pressure $P_1$ of State A. If the working fluid at State B were noncondensible it would be possible to envision a "free recompression" by constant cooling of the fluid by maintenance of constant temperature in the fluid during compression. As in Joule-Thompson expansion, the fluid would experience little rise in enthalpy. For a condensible fluid however, a rise in pressure will be accompanied by condensation and the accompanying release of latent heat of vaporization will result in a temperature rise. Thus the analogue to the isothermal recompression of a noncondensible gas is the isenthalpic compression of a condensible gas. This, in a sense, is the counterpart of irreversible or "free" expansion.

The idea of irreversibility implying overwhelming spontaneity would seem to permit such a process to take place only in the direction of the static pressure gradient. It should be noted, however, that the preferred isenthalpic compression device hereinafter described resolves this problem by the same principle as an analogous problem, flight in heavier-than-aircraft. By the principle of Bernoulli, potential energy is temporarily converted to kinetic energy, thus providing a favorable localized pressure gradient. Naturally, the practicalities demand that some work be done to move the fluid, to overcome friction, etc., so there are departures from true constant enthalpy. These considerations prevent realization of irreversible adiabatic compression with a resulting enthalpy higher than that predicted. The energy expenditures, however, will still be significantly less than that required for reversible isentropic recompression.

Although there are other devices for achieving isenothalpic compression, this invention contemplates the use of three distinct types of devices hereinafter referred to collectively as "isenthalpic compressors" for forcing an isenthalpic compression of the working fluid from State B to State C. These devices seek to accomplish isenthalpic compression by: (1) conversion of velocity head, (2) direct compression with controlled temperature rise and (3) recompression of vapor absorbed into a liquid state. All three methods associate a larger mass of circulating incompressible liquid hereinafter referred to as the "motive fluid" with the working fluid to be recompressed. The motive fluid behaves in subtly different ways in each of the three methods but nonetheless continues in each method to fulfill the function which this invention has termed a "work sink" as it cycles between an energized and a deeenergized state. In the various applications of this invention circumstances dictate a choice between two alternative routes to provide an increase in working fluid pressure, recognizing nevertheless, that all such pressure increases must originate with the pumping of an incompressible liquid phase. When the motive fluid is identical to the working fluid, it will always be in such cases, that the working fluid can be conveniently induced to join the motive fluid which has already been pumped to its energized state. In the case of absorption those circumstances are replaced by the selection of a motive fluid capable of dissolving the working fluid while still in the deenergized state thus producing a mixture in a single incompressible liquid phase which may then be pumped in total to a State C.

The preferred method for effecting the transition from B to C involves the conversion of velocity head and the preferred device for accomplishing this, for reasons of simplicity, thermal efficiency and irreversibility, can best be characterized as a jet eductor (or "jet compressor"). Such a device is depicted in FIG. 2. Normally jet compressors use a gas as the motive fluid in order to effect the eduction of a gas or liquid'ala the operation of a lady's perfume atomizer. This invention on the other hand uses a liquid as the motive fluid in order to educt and recompress gases, i.e., turbine exhaust vapor, spent steam, etc. In this application the jet compressor would operate as follows. The potential energy of a high pressure incompressible motive fluid is converted to the kinetic energy of high velocity with an accompanying lowering of temperature and pressure in amounts describable by the laws of adiabatic expansion. Thermal efficiencies of 97% can be expected. The design of the nozzles employed in such eductors will provide, by design, reductions in pressure such that a receiving chamber (or "throat region") for the moving motive fluid, will be at a pressure lower than the pressure of point B. Such a pressure gradient permits the induction of the total vapor volume into said throat region. According to the laws of conservation of momentum, the motive fluid will thereupon impinge axially, entrain and combine with and then accelerate the induced vapor. The entrainment feature could also be referred to as a "mixture" of the motive fluid and the working fluid. In providing the motive fluid in this step, the amount so provided need not be restricted to the amounts naturally occurring as a proportion of the total working fluid. Larger amounts of motive fluid may be circulated and accumulated by recycle accumulation as the vehicle both to convey the vapor and compress it to a higher pressure. Surplus quantities of motive liquid can then be returned to a reservoir maintained by the self-same eductor or another jet eductor at system low pressure and temperature for this purpose. Work is added to the motive fluid in quantities sufficient to maintain the energy of the motive fluid and the entrained working fluid (which is by and large vapor) at the mechanical energy level originally possessed by the motive fluid before the work was added.

Motive fluid energy levels aside, the main function of the entrainment or mixing step is to absorb into the working fluid in State B, the energy provided by the incompressible motive fluid having an energized state and temperature higher than that of the working fluid by placing the two fluids in energy communication and thereby forcing them, in attaining thermal equilibrium (thus sharing kinetic energy also) to share their respective energies so that in in effect the energy of the working fluid is increased. It should also be noted that although the "mixing" in the jet eductor implies physical contact between the motive fluid and the working fluid, this is not absolutely necessary for a communication of energies, as will be shown in other isenthalpic compression devices hereinafter described.

Another important function of the jet compressor is to help provide (in conjunction with a motive fluid pump) the appropriate quantities of motive fluid to the energy communication; it being implicit that the energized state of the working fluid is the deenergized state of the motive fluid. Hence, by fixing the energized state of the motive fluid, prescribing the State C for the working fluid and fixing the quantity of working fluid in State B, the quantity of motive fluid required will thus become uniquely determined for the purpose of repressuring the working fluid from State B to State C adiabatically. The provision of the required amount of motive fluid is preferably accomplished by recycle accumulation of the motive fluid liquid by methods shown in FIGS. 2A, 3 and 4 of this disclosure. Adjustment of rates of circulation and taping external sources are also obvious methods for provision of motive fluid. At least a portion of the repressuring takes place at some point along the path from State B to State C where the temperature $T_2$ is not only less than $T_1$ but also lower than the critical temperature of the combined motive fluid and working fluid in the proportions in which the fluids are employed. When the motive fluid and working fluid are of the same chemical species, this implies that the repressuring takes place at some point below point CP in FIG. 1.

Returning now to the description of flow through such a jet eductor, we note that the combined motive and working fluids leave the throat region and enter a succeeding section of increasing cross sectional area ("recompression outlet") causing the isentropic deceleration of the total fluid accompanied by some recondensation, due to the increase to stagnation temperature and pressure by means of which the total energy balance of isenthalpic compression is preserved. Since the motive fluid's energy remains constant in the circulation, the work added to the motive fluid when shared with the working fluid accrues to the working fluid, with the motive fluid serving as a transfer agent, i.e., the "work sink" of this invention. By this means the working fluid attains a State C (pressure $P_3$ approximating $P_1$ and temperature $T_3$ intermediate to $T_1$ and $T_2$) without the working fluid passing through X, i.e., without discarding its latent heat of vaporization. Some engineering calculations for the operations of such a jet pump in helping to achieve the isenthalpic compression just discussed are given hereinafter in examples 2 and 2A which are associated with FIGS. 2 and 2A, respectively. However, before getting to such calculations it is very helpful to have the following analogy in mind.

The above isenthalpic recompression can be thought of as an absorption by the working fluid of the energy of a greater mass and contained energy of a circulating relatively incompressible motive fluid which in effect acts as an energy "flywheel" at constant moment of inertia. By governing the nature, state and employment of this motive fluid, by means of the processes and devices described herein, the working fluid is induced to join and to share the flywheel energy, thus gaining a disproportionate amount of that flywheel energy. By employing an external mechanical energy source and/or a portion of the output shaft work of the total cycle, the flywheel energy can be maintained at a constant level. That is, work is added to the motive fluid in quantities sufficient to maintain the average mechanical energy of the combined motive fluid and exhaust vapor at the original level of the motive fluid itself. Thus the amount added to the recycle is sequestered to, and realized as potential and/or kinetic energy (i.e., pressure and velocity) in the working fluid. This causes the liquid at the vapor/liquid phase envelope to be raised along the envelope to a new temperature, with the accompanying portion of remaining vapor being raised to the same new temperature and pressure. In essence this represents climbing a step within the envelope to a new plateau in which the location of the total fluid will have moved toward the liquid, i.e., left side of the vapor/liquid phase curve directly in proportion to the fraction of the vapor liquefied in gaining that step. This step can be repeated as required until the fluid substantially reaches State C pressure which approximates the working fluid's initial pressure at some State C temperature intermediate to the temperature at State B and at State A. Naturally at some point along the path from point B to point C pressure must be applied while the working fluid is below its critical temperature. When released or separated from the motive fluid, the working fluid incorporates the recycle energy which it restores to the cycle without appreciable net loss. This separation takes place between State C and State A. The amount of the circulated energy, being work done upon an incompressible fluid, is relatively small compared to the total energy of the flywheel. From the thermodynamic standpoint the conventional prior art path leading from point B to point X (X being the state of the saturated liquid at the pressure and temperature of point B) involves the discarding of the latent heat of vaporization of the working fluid in order to effect the condensation of the working fluid and then repressuring and heating the working fluid successively to points C and A. Since point C is at the same enthalpy as point B and since enthalpy is a function only of state, independent of path, it follows that the change in enthalpy from point B to point X is precisely equal to, but opposite in direction to the change involved in moving from point X to point C; with the net change in enthalpy being equal to zero, that is to say, this invention employs a large auxiliary energetic mass to collect and conserve the energy of the working fluid at point B. By the addition of the energy equivalent to the change from point C to point C' this invention accomplishes the path from B to C forcing the change of state thus represented without passing through point X. I have termed the auxiliary mass thus employed a "work sink" and the action accomplished—an approach to irreversible adiabatic compression—an "isenthalpic coompression."

Now placing the isenthalpic compression aspect of this invention in its preferred environment we obtain a "closed" thermodynamic cycle process comprising (1) expanding a working fluid having State A (represented by a pressure $P_1$ and a temperature $T_1$) outside the vapor/liquid phase curve for the working fluid to a resulting exhaust fluid having State B (represented by a pressure $P_2$ lower than $P_1$ and a temperature $T_2$ lower than $T_1$), (2) compressing the exhaust fluid through the agency of energy absorbed from an excess of pumped motive fluid provided to form a net portion of fluid, which is compressed as a liquid along an isenthalpic line from State B to a State C (represented by a pressure $P_3$ which approximates $P_1$ and a temperature $T_3$ which is intermediate to temperature $T_1$ and temperature $T_2$), (3) separating the working fluid from the motive fluid and (4) heating the fluids to restore the original $T_1$ temperature of State A.

Although preferred, the conversion of velocity head in a jet eductor is not the only method by which isenthalpic compression can be accomplished. As previously noted among others, the method of direct compression with controlled temperature rise and the method of recompression of a vapor absorbed into a liquid are also available. Direct compression with controlled temperature rise achieved by an apparatus such as that shown in FIG. 4 is particularly suited for the recuperation of the highest working pressure in the working fluid without the accompanying expenditure of the work of isentropic compression. Such a process involves working and motive fluids idealized respectively as vapor and liquid in vapor/liquid equilibrium of temperature and pressure of State B. The liquid motive fluid would be drawn from some reservoir such as the one shown in FIG. 4, or from the constant inventory of a disengaged drum as shown in FIG. 2A by means of a pump which would produce an increase of motive fluid pressure to exceed the vapor pressure anticipated at temperature C'. Thus, upon receiving the latent heat of vaporization of the condensate portion of compressed working fluid in the course of its isenthalpic compression, the motive fluid would experience a rise in sensible heat content and temperature without itself undergoing any degree of vaporization.

Upon delivery to the cooling jacket of an isothermal gas compressor this motive fluid would then communicate heat with the working fluid in the compression chamber. As shown in FIG. 4 the cooling jacket is in energy communication with the vapor in the compression chamber but, in contrast to the jet eductor energy communication by mixing, the vapor and the motive fluid in the cooling jacket do not come into physical contact in the compressor. The gas compressor draws net working fluid vapor at temperature and pressure of State B directly from the exhaust of a turbine or via a disengaging drum.

Accompanying each increment of pressure rise in the compression chamber as the working fluid vapor is caused to lose volume will be an adiabatic rise in temperature much greater than the increase experienced by the motive fluid upon its compression as an incompressible liquid. Successively then as higher pressure levels are achieved in the working fluid vapor, sensible heat and latent heat of vaporization will be transferred to the motive fluid and a portion of the vapor condensed. The net rise in temperature is experienced equally by the total motive and working fluids. These incremental steps as herein described are imaginary. The actual complete compression in the compression chamber will atain the full working pressure of States C and A with the accompanying rise of temperature required to reach point C. The advantages here are that in reducing the amount of motive fluid from the conventional operation of an isothermal compressor which discards all the working fluid's latent heat of vaporization, the jacket coolant becomes the recipient and temporary holder of such latent heat, but itself rises in temperature and retransfers back to the working fluid condensate and vapor, at the high pressure, all of the latent heat originally yielded. Effectively, then, recompression of the working fluid has been accomplished without the expenditure of the isentropic work of compression by the accumulation and restoration of the latent heat of vaporization in the work sink of a compressed motive fluid such that the apparatus as a whole acts as isenthalpic compressor and brings the working fluid to State C.

In an apparatus analogous to FIG. 2A (however, modified by the replacement of the jet eductor by the isothermal compressor) the jacket coolant and compressed working fluid would be returned to a disengaging drum in which the separation and restoration of amounts of working and motive fluids would be reestablished.

A third method for achieving isenthalpic compression is by first rendering the working fluid vapor in State B incompressible by dissolving it in a selected high boiling deenergized motive fluid. The single phase mixture may then be pumped directly to State C. Heating to State C' to evaporate the working fluid makes possible a phase separation. This can be done by providing a suitable solvent of much lower volitility than the working fluid so that when dissolved in such a solvent, which thereupon becomes a "motive fluid," the working fluid is rendered incompressible in the liquid state by absorption as the counterpart to low temperature condensation. For such a system, the State B to State C thermodynamic path of this invention takes the following form. The working fluid is absorbed into sufficient quantities of the solvent motive liquid provided at a temperature and pressure that will result in a single liquid phase of the combined fluids. A pump is selected which has a special design parameter to reflect the exigencies of the combination, that is, its net positive suction head requirement matches the net positive suction head available at the elevated vapor pressure of the mixture. The pump then has the duty of elevating the pressure of total liquid to State C. In this case however, a natural means of separation has yet to be encountered. This arises in the subsequent heating of the combined liquid, whereupon a second phase, a vapor phase, reappears and the high volatility working fluid becomes readily separable.

Having thus described absorption as a general method for achieving isenthalpic compression i.e. dissolving a low boiling working fluid in a high boiling motive fluid to provide a single incompressible liquid phase, we now introduce distillation as a specific example as shown in FIG. 5.

A gasoline stabilizer is designed to separate $C_3$ and lighter hydrocarbons from $C_4$ and heavier hydrocarbons (gasoline). The total production of unstabilized gasoline is introduced to the suction of a charge pump which develops a total discharge head (pressure) greater than the vapor pressure of the light hydrocarbon at cooling water temperature. After preheating by heat exchange with the net gasoline product the feed is introduced to a central stage of the multiple stage distillation column (rectifier). This stage is selected to match the compositions of the vapors and liquids traveling within the column such that all stages above the feed stage will serve to enrich the upward vapor traffic in light hydrocarbons by absorption of the heavier components in the internal liquid reflux and all stages below will serve to strip the liquid traffic of light hydrocarbons by means of the rising internal vapor stream. By this means the overall rectification of multiple vapor/liquid equilibrium stages provides the quantitative separation originally intended. Furthermore, the operation of the multistage rectifier is tantamount to that of an absorber-stripper system The separated light portion (overhead product) thereupon passes through the overhead vapor line of the column and is cooled and condensed by cooling water to arrive at a receiver. A quantity of this liquid overhead product is withdrawn for return to the uppermost stage of the rectifier as reflux. Net quantities of liquid in the receiver are pressured to storage as the overhead product.

Simultaneously at the bottom of the column liquid gasoline is withdrawn and reboiled by a source of external heat thereby providing partial vaporization for reintroduction to the bottommost vapor space of the rectifier. From the liquid portion of this return, net gasoline production is withdrawn, its sensible heat is recovered by transfer to the incoming feed, and after further cooling is pressured to storage.

It should be noted that all stream movements and system internal pressures are generated at one place: the charge pump feeding the system.

The gasoline stabilizer just described may be conveniently used as an isenthalpic compressor for useful work production without affecting its original function. Upon physically assessing the total capacity of the overhead systems for handling the gross traffic of vapors and thus determining that there exists unused capacity, that quantity is withdrawn from the overhead vapor line of the rectifier as a working fluid. Additional heat may be supplied subject only to availability. The superheated vapor at full stabilizer pressure is expanded in a polytropic engine to State B. The working fluid may be then used as a refrigerant to the extent limited by vapor pressure considerations for it is then conveyed directly back to the suction of the charge pump as a recycle stream.

Simultaneously, the net positive suction head (NPSH) requirements of the pump are considered and a quantity of net gasoline bottoms product withdrawn before transfer to storage for recycle to the suction of the charge pump such that those NPSH requirements are satisfied. Thus when employing a gasoline stabilizer as an isenthalpic compressor, it is within this charge pump that the working fluid proceeds from State B to a State C. Achievement of State C' will take place after additional heating within the rectifier which provides separability by conversion of the working fluid to the vapor phase.

In effecting the reheating of the working fluid from State C' to the original high pressure and temperature of State A, as well as in effecting the required separation of the working and motive fluids, the heat exchanger means (heat exchanger, cooling tower, etc.) can utilize any convenient source of heat such as that from ambient conditions of the earth's atmosphere, ambient conditions in space, bodies of water found on earth, solar heaters, geothermal sources, fossil fuel oxidation, nuclear reactors, industrial processes such as absorption, distillation, etc., and primary heat sources such as furnaces, chemical reactions, as well as waste heat sources such as coolant effluents and stack gases. Like the A to B portion of this cycle, the C to A portion of the cycle, is also a well known prior art, and implicit in the heat exchange in moving from point C back to point A is the fact that refrigeration at a wide range of temperatures is made available by methods well known to the art. It should be noted that this refrigeration recovery is in addition to the shaft work produced, when A is at ambient temperature.

As in the case of the isenthalpic compression by the jet eductor, a separation of the working fluid and motive fluid is required after reaching State C. That is to say, regardless of the means employed to accomplish the isenthalpic compression, the total upon arriving at State C must be separated into motive and working fluid to complete the recompression taught by this invention. The considerations that will have dictated the optimum selection of motive and working fluids together with an appropriate isenthalpic compression device "naturally" will have included and thus provided the means of restoration of the two fluid quantities. To this end there are three general cases that effect the circumstances of separation. They are (1) direct recompression of identical motive and working fluids, (2) direct recompression of different motive and working fluids and (3) absorption followed by heating of different motive and working fluids. In the case of identical motive and working fluids, since it is self-evident that the motive fluid must exist at State C, no chemical differentiation is necessary. It suffices to maintain a constant inventory as a source of motive fluid and distinguishing any and all other fluid as "working fluids."

In the cases of different chemical species however, subsequent heating following State C will in general be necessary, since the device of different chemical species will have been invoked to take advantage of a sharp definition of volatility. Thus, separation of the motive fluid from working fluid by phase at some point at or following State C but before arriving at State A must involve the recreation of the working fluid in the vapor phase by the addition of the latent heat of vaporization.

A preferred separation technique is to maintain a constant motive fluid source inventory, at a temperature achieved in effecting the transition from State C to State A, within a vessel that receives the total liquids formed in the compression and then withdrawing any surplus liquid which will be perforce working fluid. In most cases of separation, either for maintaining inventories or pressures, identifying surpluses and separating phases, a disengaging drum is a convenient and preferred device. As was noted in the case of the absorption method for achieving isenthalpic recompression, another convenient method is first to repressure the two fluids by means of a pump and thereafter apply heat to vaporize the total quantity of fluid and thereby provide the means for the ready separability of the two fluids.

Implicit in the idea of the separation of the working fluid from the motive fluid is that these two fluids can be different fluid chemical species or the working fluid and/or motive fluids can themselves represent chemical mixtures. Some of the more common working fluids, with their critical temperatures and critical pressures would include the following fluids with their refrigerant number designations where appropriate, as taken from the American Society of Heating, Refrigerating, and Air-Conditioning Engineers, Inc., *Thermodynamic Properties of Refrigerants*, New York, (1969).

| Working Fluid | Refrigerant No. | Critical Temp °F. | Critical Pressure PSIA |
|---|---|---|---|
| Argon | 740 | −188.12 | 710.4 |
| Oxygen | 732 | −181.08 | 736.8 |
| Air | 729 | −221.31 | 547.4 |
| Nitrogen | 728 | −232.40 | 493.1 |
| Neon | 720 | −379.74 | 384.8 |
| *Helium | 704 | −450.31 | 33.2 |
| Para Hydrogen | 702P | −400.31 | 187.5 |
| Normal Hydrogen | 702N | −399.95 | 190.7 |
| Propylene | 1270 | 197.17 | 670.2 |
| Carbon Dioxide | 744 | 87.87 | 1069.9 |
| Ammonia | 717 | 217.4 | 1647.0 |
| Axeotrope R-12 | 500 | 221.9 | 641.9 |
| Dichlorotetrafluorothane | 114 | 294.3 | 498.9 |
| Chlorodifluoromethane | 22 | 83.9 | 721.9 |
| Dicholorodifluoromethane | 12 | 233.6 | 597 |
| Tricholorofluoromethane | 11 | 388.4 | 640 |
| Water | — | 705.40 | 3206.2 |
| Light Hydrocarbons | — | — | — |

*Helium has particularly attractive thermodynamic, chemical and non-toxic properties which make it ideal for many applications of the practice of this invention.

DESCRIPTION OF THE PREFERRED EMBODIMENTS

Figure 1:
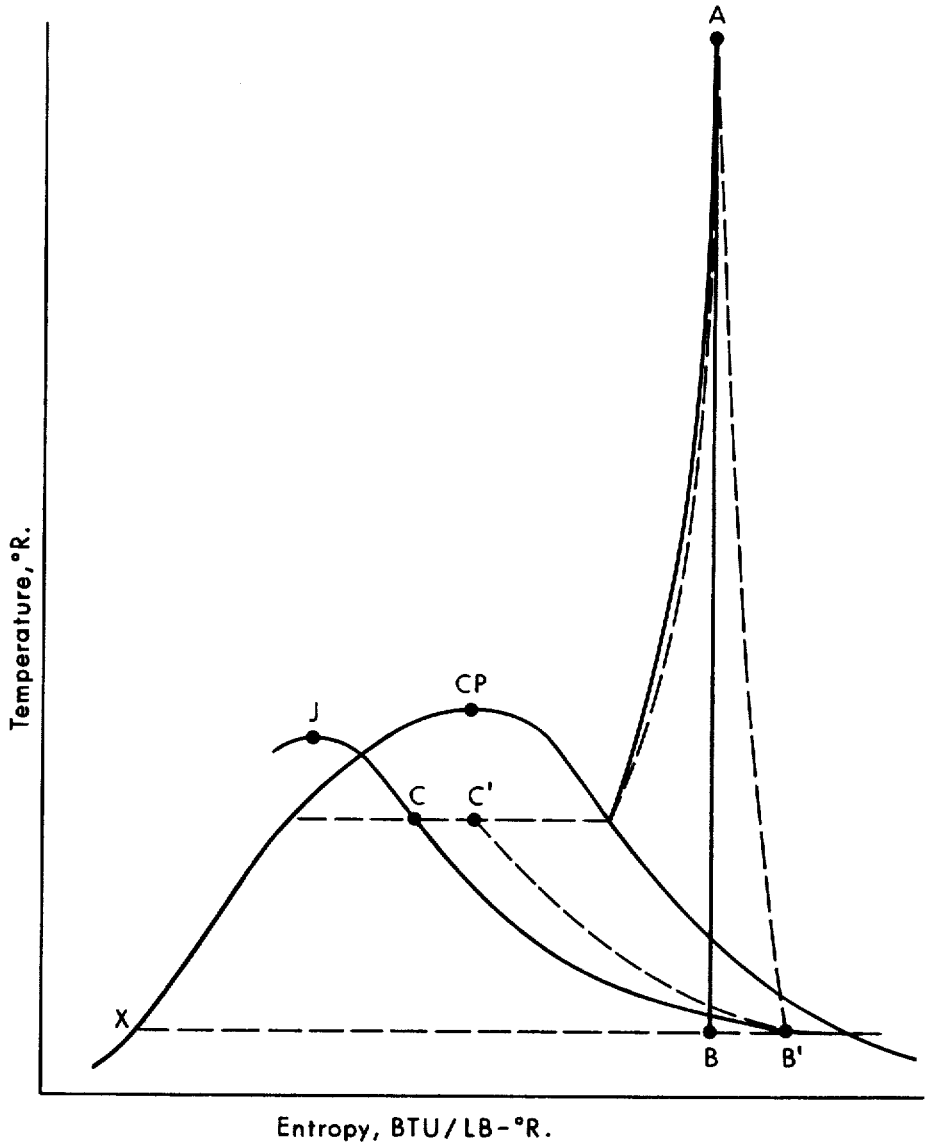
FIG. 1 is a temperature vs. entropy chart for a typical working fluid and illustrates a typical path of the thermodynamic cycle of this invention.

FIG. 1 is a temperature vs. entropy chart for a typical working fluid used in the practice of this invention. As previously discussed, lines of constant pressure and enthalpy are used to interrelate certain thermodynamic functions which can define a given state of the working fluid. The dome shaped curve depicts the boundary of the vapor/liquid phase region wherein the liquid and vapor phases may simultaneously coexist. States A, B and C are located in exemplary relative positions. State A represents the point of highest pressure $P_1$ and temperature $T_1$. State B (which is taken to include theoretical State B') represents the point of lowest pressure $P_2$ and temperature $T_2$. State C represents the system nominal high pressure $P_3$ which approximates $P_1$ and an intermediate temperature $T_3$ such that $T_2<T_3<T_1$. Points B', CP, J, C' and X are also located for clarification of certain theoretical points which were discussed in the Summary of the Invention section of this patent disclosure. It is along the B' to C constant enthalpy line that the "isenthalpic compression" of this invention is approximated for the reasons which were also discussed at length in the Summary of the Invention. States A, B and C will also serve as important reference points in the ensuing discussion of the representative devices which produce the isenthalpic compressions utilized in this invention.

Figure 2:
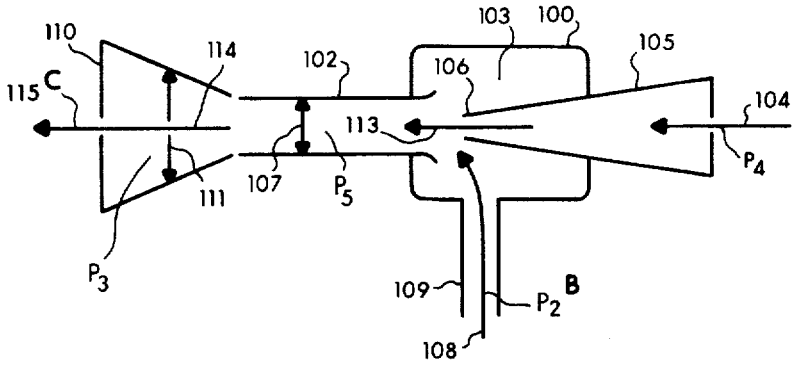
FIG. 2 is a cross sectional view of a preferred embodiment of an isenthalpic compression apparatus.

FIG. 2 shows a jet pump, which has been converted to the isenthalpic compressor application of this invention. The isenthalpic compressor 100 has a throat 102 (and optionally a chamber 103) for recycling a motive fluid 104 at high pressure $P_4$ which enters the isenthalpic compressor via a motive fluid inlet 105 having a nozzle 196. The throat 102 has a given cross-sectional area 107 (shown from the side view). The potential energy of the high pressure motive fluid 104 is converted to the kinetic energy of a high velocity (stream 113) with an accompanying lowering of pressure in throat 102 such that a pressure gradient is created between the throat having a lower pressure $P_5$ than an exhaust vapor 108 in State B (i.e. having a pressure $P_2$ higher than $P_5$) which is educted into the isenthalpic compressor 100 via exhaust vapor inlet 109. The motive fluid will impinge upon, entrain (in the area generally designated 102) and then accelerate the exhaust vapor 108 through the cross section 107. Mating with cross-sectional area 107, a recompression section with increasing cross-sectional area 111 terminates in recompression outlet 110. The increased cross-sectional area 111 creates a region of higher pressure $P_3$ which approximates stagnation pressure and a higher temperature which approximates stagnation temperature. This isentropic recompression of the total mixed fluid 114 causes a redistribution satisfying the energy balance around isenthalpic compressor 100 and recondenses a portion of the high speed fluid 114 to the stagnant fluid. Thereafter, the jet eductor effluent stream 115 may be successively passed through analogous isenthalpic compression stages until State C conditions are finally reached. Having thus described the jet eductor it is now instructive to place the jet eductor in some representative working applications to obtain useful results.

Figure 2A:
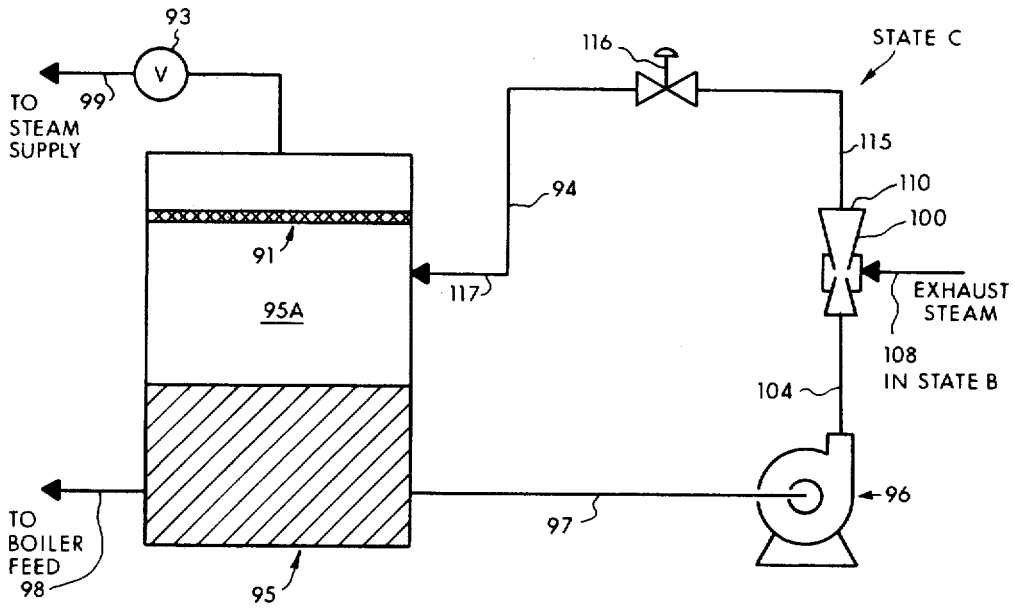
FIG. 2A is a schematic flow diagram of a basic prototype application of this invention in a steam plant system.

FIG. 2A shows the jet eductor 100 described in FIG. 2 installed in a simple prototypical application of the thermodynamic cycle taught by this invention. This discussion of FIG. 2A should be considered in conjunction with the tabulation of stream properties given in Example 2A of this patent application. Starting with the stream 115 coming out of the compression outlet 110 of the jet eductor 100, the stream 115 passes through a back pressure controller 116 as a mixed phase 94 and to a disengaging 95A of a disengaging drum 95 having a coalescing mesh 91 via conduit 117. Stream 115 has undergone a free isenthalpic expansion (Joule-Thompson) to a vapor stream 99 available as process stream via check valve 93, and a net liquid stream 98 is available for easy pumping as a boiler feed. A volume of recycle motive fluid stream 97, enters pump 96, is slightly compressed and given a velocity head which is converted to potential energy and heat of compression. The resulting sub-cooled liquid is thereafter discharged from pump 96 as motive fluid stream 104 to complete the cycle by educting the exhaust fluid (exhaust steam in this case) 108 in State B.

At this point some important observations should be made. In the first place, it should be noted that, in comparison with known steam condensation processes, the procedure just described in FIG. 2A will have recovered the latent heat of vaporization of the exhaust steam. This action could no doubt be improved with an eductor designed for this application rather than for heating of a liquid as previously noted. It should also be noted that from a steam boiler standpoint, since virtually all heat was recovered, the need for the bulk, sensitivity and expense of reducing working fluid pressure to vacuum levels, barometric legs, condensing turbines, surface condensers, etc., are all obviated.

Figure 3:
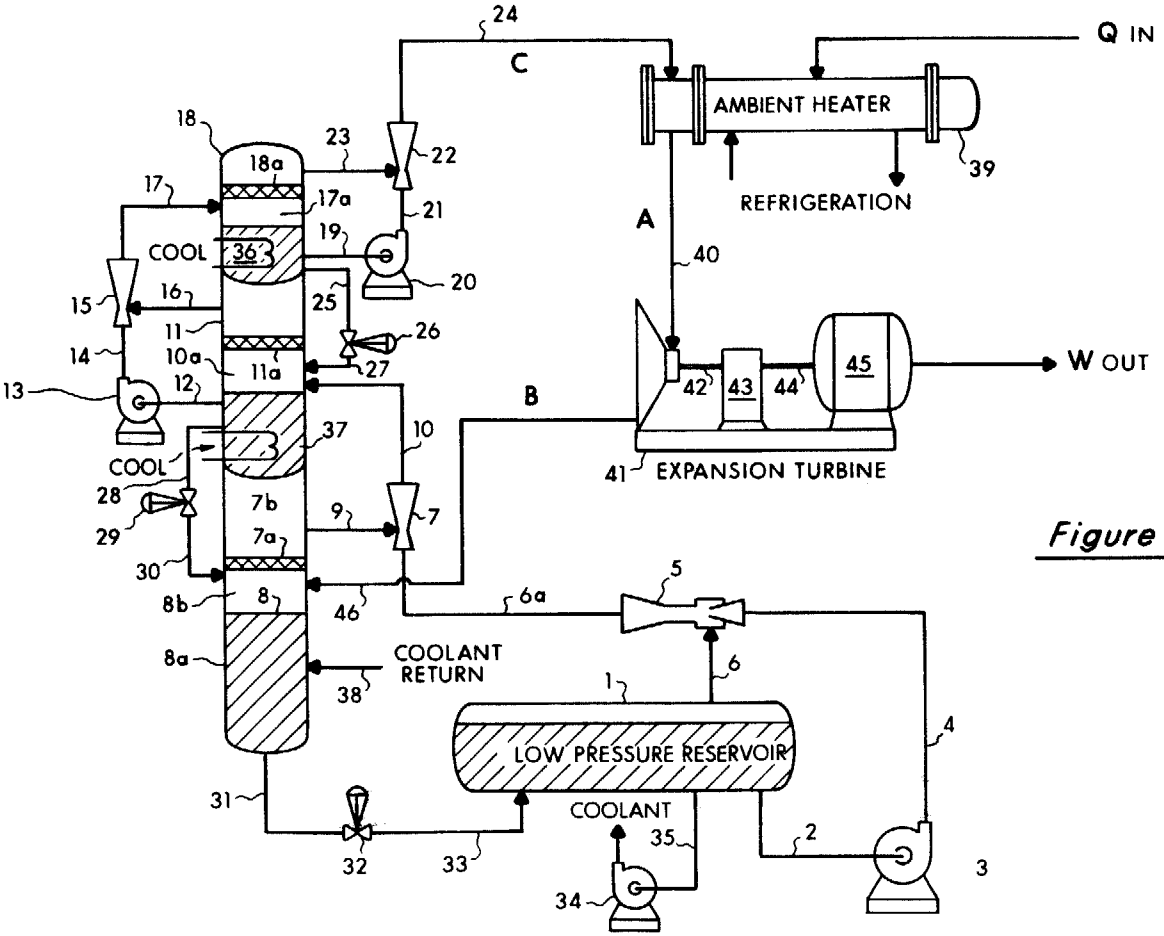
FIG. 3 is a schematic flow diagram of a thermodynamic cycle apparatus having a series of jet eductors and disengaging drums.

FIG. 3 depicts a preferred embodiment of another isenthalpic compression system capable of producing the thermodynamic cycle of FIG 1. It starts with a reservoir 1, at a low pressure, used for restoring the working fluid inventory and providing adequate reserves of motive fluid. Liquid working fluid is withdrawn from the low pressure reservoir 1 through conduit 2 into the suction of a first stage pump 3 and delivered in the liquid phase through conduit 4 as motive fluid to jet eductor 5 which draws vapor from low pressure reservoir 1 through conduit 6. The full combined mixed phase discharge of jet eductor 5 is delivered through conduit 6a, to a second stage eductor 7. This eductor 7 draws vapor from vapor space 7b of disengaging drum 8a via conduit 9 due to a pressure gradient created by the second stage eductor 7. The disengaging drum 8a has a coalescing screen 7a which separates the vapor space 7b from a disengaging space 8b. A liquid 8 collects in the bottom of the drum 8a. The combined mixed phase discharge of the second stage jet eductor 7 is delivered via conduit 10 to a disengaging space 10a of intermediate disengaging drum 11. Liquid is drawn from the liquid level of intermediate disengaging drum 11 via conduit 12 through the suction of an intermediate stage pump 13 and delivered via conduit 14 in the liquid phase as motive fluid to a third stage jet eductor 15. Vapor from the vapor space of disengaging drum 11 is fed via conduit 16 to the suction of jet eductor 15. A permeable means 11a such as a coalescing mesh separates the disengaging space from the vapor space of disengaging drum 11. A mixed phase fluid leaves jet eductor 15 through conduit 17 to a disengaging space 17a of a final disengaging drum 18 also having a permeable mesh 18a. Delivery pump 20 draws liquid via conduit 19 from below the liquid level of disengaging drum 18 and via conduit 21 provides motive fluid for a final stage jet eductor 22. Vapor leaves the vapor space 18a of disengaging drum 18 via conduit 23 due to the suction of jet eductor 22. The combined mixed phase effluent of eductor 22 is then fed via conduit 24 to subsequent sections of the total process which will be described hereinafter. The effluent is in State C as it leaves eductor 22. The above process describes the successive movements of working fluid in converting vapor to liquid in one direction through various stages of recompression. In tracing these movements three distinct pumping means were shown but it should be realized that one master pumping means might replace the three individual pumping means.

The back flow of liquids will now be described. Liquid is drawn from disengaging drum 18 via conduit 25 through throttle valve 26 and returned as mixed phase via conduit 27 to the disengaging space 10a of the intermediate disengaging drum 11. Liquid from the intermediate disengaging drum 11 is withdrawn via conduit 28 through throttle valve 29 and the mixed phase resulting is transferred via conduit 30 to the disengaging space 8b of the initial disengaging drum 8a. Liquid from disengaging drum 8a is withdrawn in the liquid phase via conduit 31 and throttle valve 32 and in a mixed phase, via conduit 33, returned to low pressure reservoir 1. Coolant in any required amounts may be withdrawn from low pressure reservoir 1 via conduit 35 and circulated by coolant circulation pump 34 via conduits not shown to the cooling coil 36 in disengaging drum 18 and cooling coil 37 in disengaging drum 11 and the combined fluid returned via conduit 38 to the liquid 8 of initial receiver 8a.

Returning now to the description of the subsequent C to A and A to B stages of this thermodynamic cycle we see that, via conduit 24, a mixed or single phase working fluid in its entirety, and in State C, enters heat receiving ("ambient heat") means wherein heat Q, from whatever available sources employed, is delivered via suitable heat exchange equipment 39. This equipment 39 can be capable of simultaneously supplying refrigeration. The total working fluid now in the vapor phase, and at State A, enters an expansion turbine 41 via conduit 40 and rotates the turbine by expanding through it to State B. The fluid emerges through conduit 46 to return to disengaging space 8b of disengaging drum 8a. The expansion turbine's shaft 42 can be connected to arrays of reduction gears 43, other shafts 44 and generating devices 45 etc., using known methods and equipment to produce shaft work W.

The steps associated with the conversion of the properties of the working fluid from State C to State A and from State A to State B are common to all versions of the thermodynamic cycle of this invention, although not necessarily in this same order. In certain applications, however, it may occur that factors arising from such sources as the nature of ambient conditions, sources of ambient heat, the selection of expansion and work generation equipment, as well as the selection of the working fluid itself may be such that appreciable portions of liquid may be provided at condition B. In those circumstances, simplifications of the entire scheme and apparatus of this invention are possible which eliminate much of the machinery of FIG. 3 but with the added feature of incorporating a gas compressor into the system.

Figure 4:
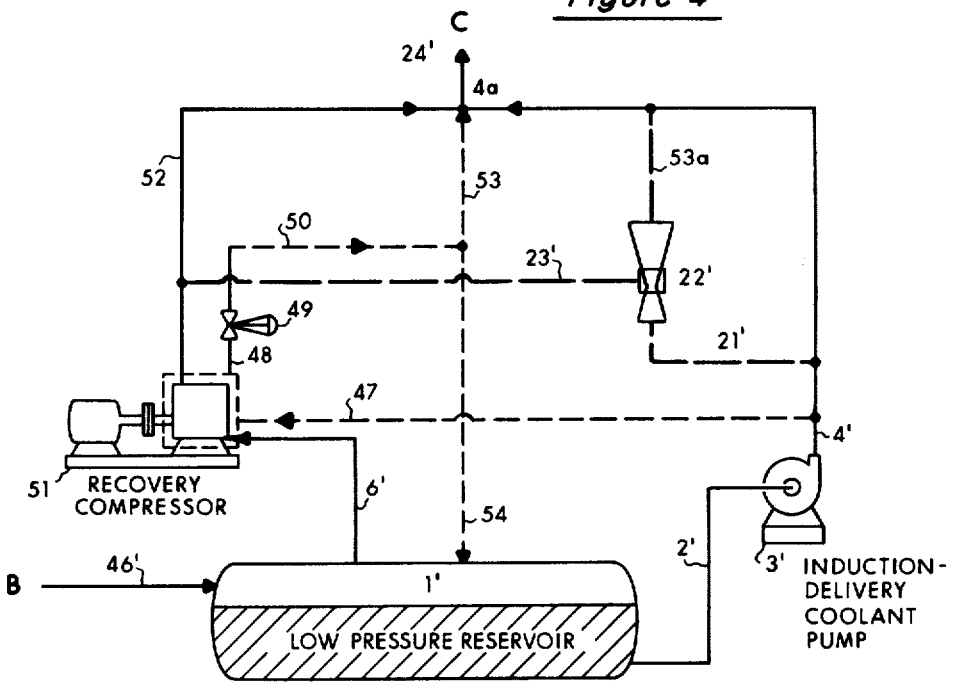
FIG. 4 is a schematic flow diagram of three versions of an isenthalpic compression apparatus having a recovery compressor for effecting a transition of the working fluid from State B to State C.

FIG. 4 shows how much simplifications can be accomplished. Points B and C as depicted in the temperature versus entropy chart of FIG. 1 are also located in FIG. 4 where they occur in this additional example of the kinds of apparatus which can be used to accomplish the thermodynamic cycle of this invention. For clarification and to emphasize the similarities in equipment and conditions where they do exist, the nomenclature and numbering system used in FIG. 3 will be transposed to FIG. 4. A prime mark will however be added to the numerical designations of FIG. 4 for any purposes of differentiation which may arise.

FIG. 4 provides three more versions of the basic kinds of apparatus which can be used to accomplish the teachings of this invention. The first version is the simplest and interrelates the equipment with only solid connecting lines. The second version employs both the solid connecting lines and short dashed lines of connection. The third version, which approaches the version shown in FIG. 3, employs both solid connecting lines and long dashed lines of connection. The discussion of FIG. 4 will be limited to the modifications of the methods and apparatus needed to carry out the B to C step, i.e., the isenthalpic compression step, it being understood that the A to B and C to A steps can remain substantially the same as those depicted in FIG. 3.

Point B representing the low pressure and temperature conditions of the working fluid, and point C representing the product of the isenthalpic compression at full process pressure, but at an intermediate low temperature, are depicted as terminal points B and C in FIG. 4 and coincide with States B and C in FIG. 1. As in FIG. 3, the low pressure reservoir 1' is that portion of the apparatus wherein a liquid inventory for start-up and use as a motive fluid is maintained at all times. In a first version of the isenthalpic compression apparatus, a liquid motive fluid is withdrawn from low pressure reservoir 1' via conduit 2' by an induction delivery coolant pump 3', the single pump of this version of the apparatus. Full process pressure is delivered by the pump via conduit 4' to a junction point 4a at condition C. At the same time, the effluent of the turbine stream 46' in State B is delivered to the low pressure receiver 1' and the vapor portion thereof removed via conduit 6' by recovery compressor 51 added to these versions of the invention as a modification. Recovery compressor 51 delivers full process pressure and via conduit 52 delivers the fluid at condition C to Junction 4a.

Line 52 could also include a disengaging drum with its ancillary equipment (not shown) to provide means of achieving higher pressures in an isenthalpic compression than can conveniently be achieved in multistage jet eduction.

This first version of FIG. 4 does not employ a jet eductor to accomplish the isenthalpic recompression. In reality, this version of FIG. 4 is only practical in cases having substantial liquid working fluid in the turbine effluent, in which case, the liquid and vapor are simply handled separately. Clearly this would be a rare and fortunate set of circumstances and in any but large quantities of liquid, this is an impractical application of the principles of this invention. As a degenerative case however, this version of FIG. 4 serves the function of clearly demonstrating that there are no theoretical obstacles to the principles embodied by this invention and that the laws of thermodynamics are not violated.

The second version using solid and short dashed connecting lines describes those circumstances where the quasi-isothermal compressor 51 is used to approach some degree of isenthalpic operation. Under such circumstances liquid in proportion to amounts generated by the work generation process will be withdrawn from low pressure reservoir 1' through conduit 2' and delivered to the single induction delivery coolant pump 3' via discharge stream 4' and transferred to compressor 51 via short dashed branch 47 in all or part of the net liquid production. The total gas effluent 46' of the turbine will be delivered from the low pressure receiver 1' via conduit 6' to the suction of recovery compressor 51, and then discharged at full process pressure, via conduit 52, to junction points 4a in condition C. This isothermal version of the invention can be accomplished by jacketing the compression stages to approach isenthalpic compression by continuous cooling with the net liquid production. It should be specifically noted that the jacketing provides for an energy communication between the working fluid and the motive fluid without having physical contact between the fluids as in the case of the jet eductor. The effluent from the jacketing cooling will be delivered via conduit 48 through back pressure control valve 49 to conduit 50 and either rejoin the remainder of the total working fluid in conduit 24' via conduit 53 or returned via conduit 54 to the low pressure reservoir 1'. Again a jet eductor is not employed.

In the third version employing both solid and long dashed connecting lines, a jacketing of the compressor 51 is not shown since an approach to isothermal compression may not be warranted. In this third version, low pressure liquid is withdrawn from low pressure reservoir 1' via conduit 2' to the suction of the induction delivery coolant pump 3'. Via conduit 4' all or part of the net liquid effluent of the pump is withdrawn through conduit 21' to jet eductor 22'. At the same time, the net vapor production of the turbine effluent is withdrawn from low pressure reservoir 1' via conduit 6' to recovery compressor suction 51, and delivered at less than full working pressure of the system via conduit 52. All or portions of the net gas flow will be withdrawn via conduit 23' to the suction of jet eduction system 22'. The effluent discharge of the jet eduction system, the mixed phase, is then delivered via conduit **53*a* to junction point 4*a* so that the total working fluid at conduit 24' is delivered at condition C to the heat exchange system not shown in FIG. 4**.

Still another apparatus capable of obtaining the objects of this invention is an absorption system whose utilization in this invention is best illustrated by following it through one of its more likely applications, for example a utility operation in an existing oil refinery such as the distillation operation used to remove the 4 to 8 percent propane from gasoline. Here a vapor at moderately elevated pressure and temperature is commonly available, and its potential is rarely recovered.

Figure 5:
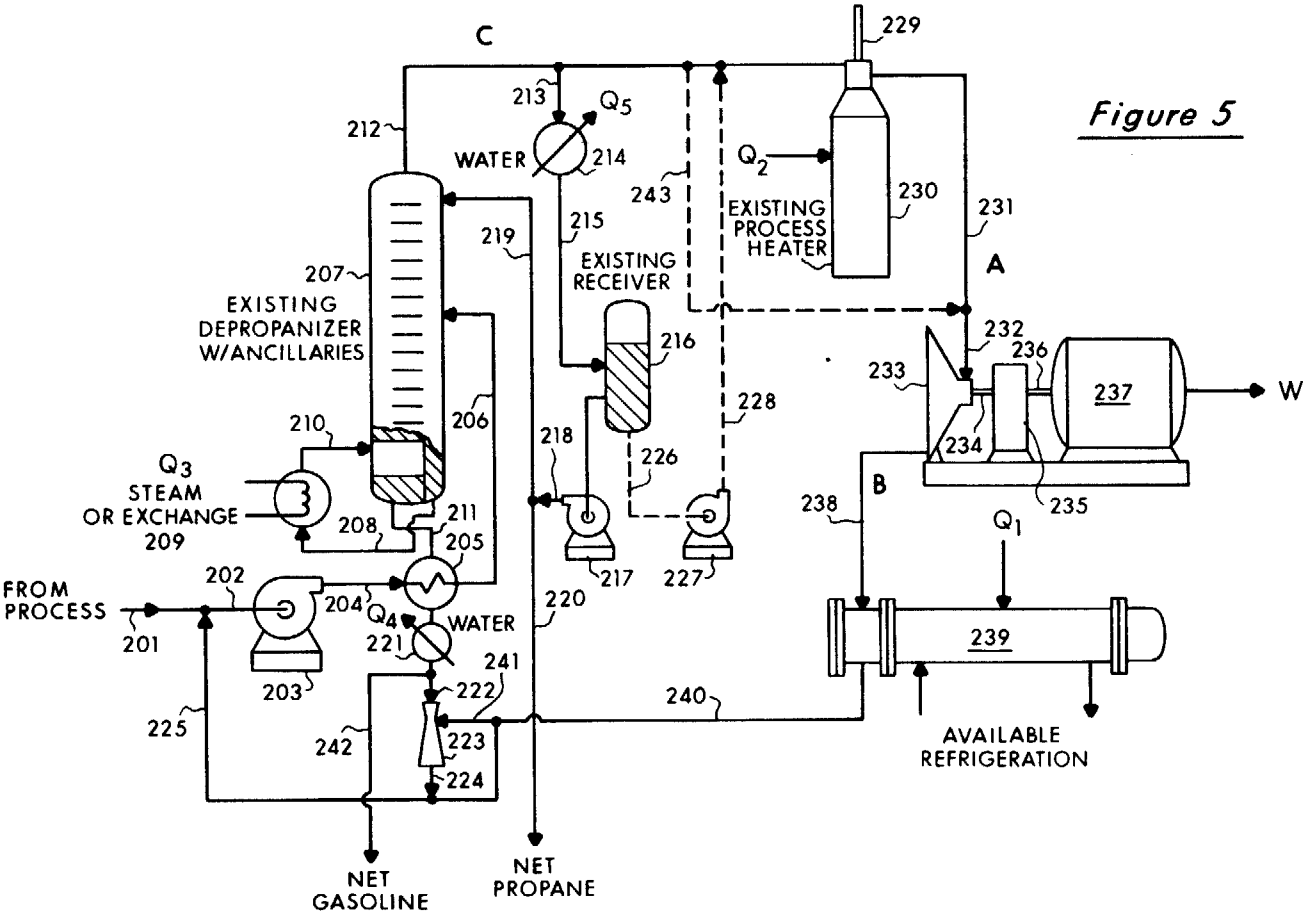
FIG. 5 is a schematic flow diagram of an absorption system wherein a soluble gas and solvent are used to accomplish the State B to State C transition taught by this invention.

FIG. 5 depicts the normal operation for the depropanization of gasoline and shows gasoline containing propane entering through conduit 201, due to suction 202 of feed pump 203. The stream is discharged through conduit 204 to heat recovery exchanger 205 and delivered through conduit 206 to the depropanizer distillation column 207. Bottoms liquid of this column are withdrawn via conduit 208 and reboiled in steam or recovery exchanger 209. Net heat $Q_3$ is delivered to the system here. The mixed phase effluent of the reboiling reenters the bottom vapor space of column 207 through conduit 210 and a liquid portion withdrawn from the bottom collecting space through conduit 211 to deliver surplus heat to recovery exchanger 205. Total overhead vapor of column 207 leaves through conduit 212 and via inlet 213 of water cooler condenser 214 is delivered via conduit 215, fully condensed, to overhead receiver 216. In the water cooler condenser heat $Q_5$ is removed from the system. Total liquid overhead product is withdrawn from receiver 216 by a product/reflux pump 217 and via discharge 218 is returned to the overhead of column 207 via conduit 219 as reflux or via conduit 220 the net propane product is sent to storage facilities not shown. Bottoms product net gasoline is received from the effluent of heat recovery exchanger 205 and cooled in water subcooler 221 in which heat $Q_4$ is removed from the system and via conduit 242 the net gasoline product is sent to storage not shown.

In the practice of this invention, net portions of the overhead product are temporarily diverted from conduit 212 via conduit 243 to the suction of expansion turbine 232 or expansion engine device not shown. Should additional waste heat be elsewhere available, the portion of overhead product withdrawn via conduit 243 can be instead diverted to a waste heat recovery unit depicted in FIG. 5 as coil 229 placed in a plenum chamber of an existing process heater 230 to recover waste convection heat and/or additional fired heat capacity currently not being utilized. At this point additional heat $Q_2$ is introduced into the system. The superheated vapor leaving the plenum chamber via conduit 231 will then be supplied to suction 232 of the expansion device 233.

The employment potentiality of such waste heat can be further enhanced as follows. The total overhead product of column 207 is, as originally, received via conduit 215 in receiver 216. In whatever amounts desirable in accordance with the excess heat available, liquid is then withdrawn in a side recycle stream via conduit 226 to be ultimately reincorporated as increased flow through the depropanizer. As before, the identical amount of overhead product continues to be available to be withdrawn for refluxing and to permit the net production of propane to be delivered to storage. In the course of the recycle, however, booster pump 227, a new element for the purposes of this cycle, receives through conduit 226 and delivers via conduit 228, a portion of recycle propane. This is returned to the inlet of the waste heat recovery facility 230 and as before, via conduits 231 and 232, enters an expansion device 233. The expansion device is rotated by the working fluid to perform such typical operations as the rotation of shaft 234 which can in turn run reduction gear 235, shaft 236 and generating device 237 to yield the gross work output W of this cycle. The effluent of expansion device 233 is delivered via conduit 238 to heat exchange means 239 which is a low level opportunity source of ambient heat, but more particularly deriving special and valuable benefit by reduction to substantially subambient temperatures. In the course of such refrigeration, heat $Q_1$ is added to the system. The recycle volume of working fluid in the vapor phase is then delivered via conduit 240 and thence conduit 225 to the suction 202 of the main feed pump 203 or in the alternative to the eductive action of an isenthalpic compressor 223.

A still further modification is available for still increased circulation capacity of the working fluid, that of increasing the circulating gasoline. The equipment capacities permitting under such conditions, any indicated practical quantities of product gasoline can be diverted at the outlet of water cooler 221 temporarily since they will, via recycle, eventually reappear in the gross flow at this point. Thus the identical gasoline production will still be available via conduit 242 to go to storage. The diverted quantity of gasoline, being under the depropanizer working pressure less small frictional losses, will be presented as motive fluid at the inlet nozzle 222 of jet eductor 223. Vapor working fluid in conduit 240 rather than following conduit 225 will be diverted via suction 241 of eductor 223, isenthalpically compressed and the combined streams fed via discharge 224 to conduit 225 for recycling.

Each of the above figures has served to describe and exemplify the idea of an isenthalpic compressor. It only remains to supplement these qualitative descriptions with one concrete quantitative example to provide a foundation of physical reality. It should be emphasized that the example is that of a rudimentary device and the mathematics are those portraying a feasible physical explanation sufficiently accurate to predict its performance. The particular method I shall follow is that of Kalustian, P., *Refrigerating Engineering*, 28, 188–193 (1934) as modified by Dodge, B. F. *Chemical Engineering Thermodynamics*, McGraw-Hill Book Company, Inc., New York, (1944). In following this method I have taken a particular model of jet eductor and given it a task to perform within its design specifications and proceeded stepwise so that the transformation of motive and working fluids are considered as they progress through their thermodynamic states.

The fundamental considerations linking the steps are reduced to mathematics and thereafter a full evaluation of all thermodynamic properties at each stage are tabulated in example 2. All thermodynamic properties of steam and water are taken from Keenan and Keyes, *Thermodynamic Properties of Steam*, John Wiley and Sons, New York (1936) employing linear interpolation.

Having explained the operation of this device in its intended application, the identical performance and its accompanying set of state descriptions are incorporated in a larger scheme. Steps, through ancillary equipment, are added; the essential mathematics of transition from state to state are described; and the state descriptions are tabulated in example 2A. A final step realizes the replication of the first stage of the original process. By this means the adaptation of a conventional jet eductor to perform as an isenthalpic compressor is quantitatively described.

Referring now to FIG. 2, 126.9 gallons per minute of motive fluid, (stream 97) 63,463 pounds per hour of saturated water at 70 psia and 302.91° F. are pumped to 155 psia at 68.4% mechanical efficiency. At one BTU per pound per °F, specific heat of liquid water, $\Delta T = 0.40°$ F.

Making compressibility corrections as taken from Keenan and Keyes for subcooled liquid at 155 psia, 303.32° F., we arrive at stream 104 of FIG. 2. The key transition in this step was the increase in enthalpy to a known pressure from which all other properties were derived.

This stream 104 now enters the motive fluid inlet of the jet eductor which is a well rounded entrance-curve flow nozzle designed to exhibit maximum thermal efficiency. Authorities such as Heat Exchange Institute, *Standards for Steam Jet Ejectors*, Third Edition, Heat Exchange Institute, New York, (1956) and Spink, L. K. *Principles and Practice of Flow Meter Engineering*, Eighth Edition, the Foxboro Company, Foxboro, Mass. (1958) report 97% thermal efficiencies, i.e., an approach to reversible adiabatic (isentropic) expansion for such nozzles. The losses of 3%, will appear as heat; thus, the hydraulic horsepower expended would be:

$$\text{Hydraulic Horsepower } HHP = \Delta P \times V \qquad \text{Equation 1}$$

$$= (155-70)\frac{\text{lbs } f}{\text{in}^2} \times \frac{144 \text{ in}^2}{\text{ft}^2} \times 0.01748 \frac{\text{ft}^3}{\text{lb } m} \times 63{,}463 \frac{\text{lb } m}{\text{hr}} \times \frac{1 \text{ hr}}{60 \text{ min}} \times \frac{HHP\text{-min}}{33{,}000 \text{ ft-lbs } f}$$

$$= 6.84\ (HHP)$$

At 68.4% efficiency, for the brake horsepower (BHP) thus added by the pump (96) we have:

$$\text{Brake Horsepower } BHP = \frac{\text{Hydraulic Horsepower}}{\text{Mechanical Efficiency}} \qquad \text{Equation 2}$$

$$= 6.84\ HHP \times \frac{1}{\frac{68.4\%}{100}}$$

$$= 10.0\ BHP$$

$$(\text{as heat}) = 10.0\ BHP \times 2{,}545 \frac{\text{BTU}}{BHP\text{-hr}} \times \frac{1}{63{,}463 \frac{\text{lbs } m}{\text{hr}}}$$

$$= 0.40 \frac{\text{BTU}}{\text{lb } m \text{ water}}$$

By the overall energy balance across the nozzle (Bernoulli's Equation) the net loss of heat (97%) will appear as kinetic energy (linear velocity). The properties of the emergent stream 113 from the nozzle then pivot on the constant entropy of perfect expansion, ascertaining the loss of enthalpy incurred in such expansion, applying the efficiency to ascertain realizable heat loss, and thus determining the actual enthalpy of stream 113, knowing the pressure in chamber 106. The properties of stream 113 are then all obtainable from the tabulations of Keenan and Keyes.

The actual loss of enthalpy incurred is 2.234 BTU per pound of motive water, all of which is converted to velocity through:

$$\Delta(U^2)\frac{\text{ft}^2}{\text{sec}^2} = 2\,g\,J\,\Delta H \qquad \text{Equation 3}$$

$$U\frac{\text{ft}}{\text{sec}} = \left(2 \times 32.16 \frac{\text{ft-lb } m}{\text{sec}^2 \text{lb } f} \times 778 \frac{\text{ft-lb } f}{\text{BTU}} \times 2.234 \frac{\text{BTU}}{\text{lb } m}\right)^{\frac{1}{2}}$$

$$= 334.5 \frac{\text{ft}}{\text{sec}}$$

The working fluid, (stream 108) 3,935 pounds per hour of steam saturated at 15 psia, 250.33° F., introduced at the inlet 108, is induced to join the motive stream in the throat region 102 and emerges as part of the combined stream 114, making a total of 67,398 pounds per hour. The thermodynamic state transformations occurring in the mixing and acceleration of the fluids are described by invoking the law of conservation of momentum, assessing the loss of kinetic energy thus incurred, devoting such losses to reheating and further vaporization and acceleration as dictated by the laws of continuity to arrive at an overall efficiency. Dodge attests to the reliability of this method of analysis in predicting efficiency and performance. Accordingly, the law of conservation of momentum states that the mass velocity properties are vectorially combinative, and in our case, assuming negligible steam inlet velocity, the law takes the following form:

$$\overrightarrow{\text{Momentum}} = \text{Mass} \times \overrightarrow{\text{Velocity}} \qquad \text{Equation 4}$$

$$\text{Mass} \times \overrightarrow{\text{Velocity}}\ (\text{working fluid}) + \text{Mass} \times \overrightarrow{\text{Velocity}}\ (\text{motive fluid}) = \text{Mass} \times \overrightarrow{\text{Velocity}}\ (\text{combined fluid})$$

It is an essential feature of the design of the jet eductor that it force the motive and working fluids to flow in the same direction. Thus the momenta of the fluids are algebraically additive. that is, $$3{,}935\ \frac{\text{lb}}{\text{hr}} \times 0 + 63{,}463\ \frac{\text{lbs}}{\text{hr}} \times 334.5\ \frac{\text{ft}}{\text{sec}} = 67{,}398\ \text{lbs} \times U\ \frac{\text{ft}}{\text{sec}}$$

$$U = 315.0\ \frac{\text{ft}}{\text{sec}}\ \text{total fluid}$$

The accompanying loss of kinetic energy is as follows:

$$\text{Kinetic Energy} = \tfrac{1}{2}\ \frac{MV^2}{g} \qquad \text{Equation 5}$$

Kinetic energy of motive stream 113 $= 1.1067 \times 10^8$ ft-lbs $f$

Kinetic energy of working fluid 108 = 0 at 0 velocity

Kinetic energy of combined fluids, stream 114 $= 1.0423 \times 10^8$ ft-lbs $f$

Net loss of kinetic energy $= (1.1067 + 0 - 1.0423) \times 10^8$ ft-lbs $f = 6.4421 \times 10^6$ ft lbs force $$= \frac{6{,}442{,}100\ \text{ft-lbs}\ f}{67{,}398\ \text{lbs}\ m\ \text{total flow}} = 95.58\ \frac{\text{ft lbs}\ f}{\text{lb}\ m\ \text{fluid (stream 114)}}$$

and hence, $$\frac{95.58\ \frac{\text{ft-lbs}\ f}{\text{lb}\ m\ \text{fluid}}}{778\ \frac{\text{ft-lbs}\ f}{\text{BTU}}} = 0.123\ \frac{\text{BTU}}{\text{lb}\ m\ \text{total fluid}}$$

kinetic energy loss. This calculation exemplifies the previously discussed "flywheel effect" wherein an amount of energy small with respect to the motive fluid liquid (which lost 13 miles per hour of velocity) is concentrated to produce a large effect on the working fluid (which gained 215 miles per hour of velocity) at the expense of 6% of the kinetic energy of the system.

The properties of stream 114 are thus determined and as usual the other tabulated values of FIG. 2 are taken from the Keenan and Keyes reference.

The energy functions of enthalpy and entropy are again pivotal for progressing from the state of stream 114 through the deceleration of the expansion nozzle (recompression outlet) to the stagnation conditions of stream 115. Again postulating almost perfect isentropic compression, stream 115 entropy is projected and the gain of enthalpy calculated from the velocity of 315 feet per second. There is no need to calculate the intermediate results of the combined stream at the end of the throat region. Regardless of how energy is here shifted from potential to kinetic energy, the restoration of energy can still be calculated as follows:

Referring to Equation 3, the relationship now holds (combining fixed constants and conversion factors)

$$\text{that: } \Delta H = \Delta\ \frac{U^2}{50{,}041} \qquad \text{Equation 6}$$

in which case ΔH is 1.983 BTU per pound of total fluid which when added to the enthalpy of 323.15 BTU per pound of stream 114 results in a total of 325.15 BTU per pound or a virtually perfect "closure" of the heat balance. Distribution of velocity and entropy is satisfied by discharge pressure of 70 psia, the balance of its properties as shown in FIG. 2 are again taken from Keenan and Keyes to complete example 2.

Now having made a plausible mathematical demonstration, as justified by the analysis presented in the Kalustian reference, for the selected design performance of the Pemberthy 2½ inch model LM Water Heater cast in the role of a jet eductor, we can incorporate that performance into those few additional steps required to utilize this device as an isenthalpic compressor.

Referring to FIG. 2A, the process of releasing stream 115 through the back pressure controller 116 is one at constant enthalpy. Upon delivery of the total stream to the disengaging space of the disengaging drum 95, the stream 117 naturally separates into liquid and vapor phases. This is calculated by the linear combination of the saturated enthalpies of the liquid and vapor as determined by the quality (percent vapor by weight) of stream 117. Such a linear combination of the saturated enthalpies yields 3,882 pounds of steam as stream 99, saturated at 70 pounds, the remainder of its properties taken from the Keenan and Keyes reference and tabulated in example 2A. The steam stream 99 is available as working fluid to process via check valve 93. The total of 63,516 pounds of equilibrium saturated water resolves into 53 pounds of net working fluid liquid, available to process, as controlled by liquid level control of the drum liquid inventory.

The identical material to the entering stream 97 of example 2 is 63,463 pounds per hour of saturated water drawn from the constant liquid inventory of the disengaging drum 95 and is available as motive fluid accumulated by recycle for delivery as a constant quantity of incompressible motive liquid to the energizing pump, thus providing a closed cycle.

| Identification Number of Stream on Diagram | Stream Fluid (quality) | Flow lbs/hr | Temperature °F. | Pressure psia | Sp. Volume ft³/lb | Entropy BTU/lb°R. | Enthalpy MM BTU/lb | Heat BTU/Hr | Velocity ft/sec |
|---|---|---|---|---|---|---|---|---|---|
| | | | EXAMPLE 2 | | | | | | |
| Design Performance as a Water Heater | | | | | | | | | |
| 97 | Water, Saturated | 63,463 | 302.92 | 70 | .01748 | 0.4409 | 272.61 | 17.301 | 0 |
| 104 | Water, Sub-cooled | 63,463 | 303.32 | 155 | 0.017421 | 0.4413 | 273.17 | 17.336 | 0 |
| 113 | Wet Steam (3.59%) | 63,463 | 250.33 | 30 | 0.7740 | 0.4414 | 270.94 | 17.195 | 334.5 |
| 108 | Steam Saturated | 3,935 | 250.33 | 30 | 13.746 | 1.6993 | 1164.1 | 4.581 | 0 |
| 114 | Wet Steam (9.27%) | 67,398 | 250.33 | 30 | 1.2897 | 0.4914 | 323.15 | 21.780 | 315.0 |
| 115 | Wet Steam (8.79%) | 67,398 | 302.92 | 70 | 0.3780 | 0.5098 | 325.14 | 21.917 | 0 |
| | | | EXAMPLE 2A | | | | | | |
| Closed Circuit for | | | | | | | | | |

-continued

| Identification Number of Stream on Diagram | Stream Fluid (quality) | Flow lbs/hr | Temperature °F. | Pressure psia | Sp. Volume $ft^3/lb$ | Entropy BTU/lb°R. | Enthalpy MM BTU/lb | Heat BTU/Hr | Velocity ft/sec |
|---|---|---|---|---|---|---|---|---|---|
| Isenthalpic Compression | | | | | | | | | |
| 94 | Wet Steam (5.79%) | 67,398 | 302.92 | 70 | 0.3780 | 0.5098 | 325.14 | 21.917 | |
| 98 | Water Saturated | 53 | 302.92 | 70 | 0.01748 | 0.4409 | 272.61 | 0.014 | |
| 99 | Steam Saturated | 3,882 | 302.92 | 70 | 6.206 | 1.1906 | 1180.60 | 4.583 | |
| 97 | Water Saturated | 63,463 | 302.92 | 70 | 0.01748 | 0.4409 | 272.61 | 17.301 | |

This simplest example is intended to be prototypical. More complicated and sophisticated designs could have shown improved performance. Nonetheless the above example does demonstrate that with the expenditure of some 26,800 BTU per hour (the equivalent of the pumping BHP at 95% efficiency) the latent heat of vaporization of 3,882 pounds per hour of 30 psia saturated steam equaling 3.670 million BTUs per hour has been retained.

This will be reused as will be the 3,925 pounds of valuable boiler feed water. Thus the principle of isenthalpic compression has been demonstrated, in this case by invoking the dynamic approach of high velocity.

These examples are given by way of illustration and should not be considered as limitations on the broader teachings of this invention. Many other obvious modifications could be made by those skilled in the art. At the very least, the principles of pumping incompressible liquids and reducing insofar as possible, without heat loss, the temperature rise in the compression of compressible fluids; the possibilities of the use of straight "isothermal style" compressors; and the use of motive fluids of chemical species other than the working fluid are all encompassed in the general goal of isenthalpic compression, that is to say, irreversible adiabatic compression without departing from the spirit of this invention and the scope of the appended claims.

What is claimed is:

1. In a thermodynamic cycle having, (1) a transition of a working fluid from a State A (representing a pressure $P_1$ and a temperature $T_1$ outside a vapor/liquid phase region for the working fluid) to a State B' (representing a pressure $P_2$ lower than $P_1$ and a temperature $T_2$ lower than $T_1$) and (2) a transition from a State C' (representing a pressure $P_3$ which approximates $P_1$ and a temperature $T_3$ which is intermediate to temperature $T_1$ and temperature $T_2$) to State A, wherein the improvement comprises effecting a transition of the working fluid from State B' to State C' isenthalpically by:

absorbing into the working fluid in State B', energy provided by an incompressible motive fluid in an energized state and higher temperature than the working fluid by placing the two fluids in energy communication by educting the working fluid into the motive fluid of a jet eductor and thereby forcing the fluids, in attaining thermal equilibrium, to share their respective energies;

providing by recycle accumulation of liquid and/or drawing upon external sources of the motive fluid the amount of motive fluid for the energy communication, as determined by:

(1) fixing the quantity of working fluid introduced in State B', (2) prescribing the State C' for the working fluid, and (3) fixing the energized state of the motive fluid, to pressure the working fluid from State B' (representing a pressure $P_2$ lower than $P_1$ and a temperature $T_2$ lower thant $T_1$ and also lower than the critical temperature of the combined motive fluid and working fluid in the proportions in which the fluids are employed) to State C' adiabatically;

energizing the motive fluid by pumping;

separating the motive fluid from the working fluid between State C' and State A by:

(1) maintaining a constant motive fluid source inventory (at a temperature achieved in effecting the transition from State C' to State A) within a vessel that receives the liquid thus formed in total, and (2) withdrawing any surplus liquid which will be perforce, working fluid.

2. In a thermodynamic cycle having, (1) a transition of a working fluid from a State A (representing a pressure $P_1$ and a temperature $T_1$ outside a vapor/liquid phase region for the working fluid) to a State B (representing a pressure $P_2$ lower than $P_1$ and a temperature $T_2$ lower than $T_1$) and (2) a transition from a State C' (representing a pressure $P_3$ which approximates $P_1$ and a temperature $T_3$ which is intermediate to temperature $T_1$ and temperature $T_2$) to State A, wherein the improvement comprises effecting a transition of the working fluid from State B' to State C' isenthalpically by:

absorbing into the working fluid in State B', energy provided by an incompressible motive fluid in an energized state and higher temperature than the working fluid by placing the two fluids in energy communication by educting the working fluid into the motive fluid of a jet eductor and thereby forcing the fluids, in attaining thermal equilibrium, to share their respective energies;

providing by recycle accumulation of liquid and/or drawing upon external sources of the motive fluid the amount of motive fluid for the energy communication, as determined by:

(1) fixing the quantity of working fluid introduced in State B', (2) prescribing the State C' for the working fluid, and (3) fixing the energized state of the motive fluid, to pressure the working fluid from State B' (representing a pressure $P_2$ lower than $P_1$ and a temperature $T_2$ lower thant $T_1$ and also lower than the critical temperature of the combined motive fluid and working fluid in the proportions in which the fluids are employed) to State C' adiabatically;

energizing the motive fluid by pumping; and separating phases and quantities of the motive fluid from a liquid quantity of working fluid produced between State C' and State A in a disengaging drum by:

(1) maintaining a constant motive fluid source inventory (at a temperature achieved in effecting the transition from State C' to State A) within a disengaging drum that receives the liquid thus formed in total, and (2) withdrawing any surplus liquid which will be perforce, working fluid.

3. In a thermodynamic cycle having, (1) a transition of a working fluid from a State A (representing a pressure $P_1$ and a temperature $T_1$ outside a vapor/liquid phase region for the working fluid) to a State B (representing a pressure $P_2$ lower than $P_1$ and a temperature $T_2$ lower than $T_1$) and (2) a transition from a State C' (representing a pressure $P_3$ which approximates $P_1$ and a temperature $T_3$ which is intermediate to temperature $T_1$ and temperature $T_2$) to State A, wherein the improvement comprises effecting a transition of the working fluid from State B' to State C' isenthalpically by:

subjecting the working fluid to a Joule-Thompson free expansion to subcool and liquify a portion of the working fluid before the fluid undergoes a transition from State B' to State C';

absorbing into the working fluid in State B', energy provided by an incompressible motive fluid in an energized state and higher temperature than the working fluid by placing the two fluids in energy communication by educting the working fluid into the motive fluid of a jet eductor and thereby forcing the fluids, in attaining thermal equilibrium, to share their respective energies;

providing by recycle accumulation of liquid and/or drawing upon external sources of the motive fluid the amount of motive fluid for the energy communication, as determined by:

(1) fixing the quantity of working fluid introduced in State B', (2) prescribing the State C' for the working fluid, and (3) fixing the energized state of the motive fluid, to pressure the working fluid from State B' (representing a pressure $P_2$ lower than $P_1$ and a temperature $T_2$ lower thant $T_1$ and also lower than the critical temperature of the combined motive fluid and working fluid in the proportions in which the fluids are employed) to State C' adiabatically;

energizing the motive fluid by pumping;

separating phases and quantities of the motive fluid from a liquid quantity of working fluid produced between State C' and State A in a disengaging drum by:

(1) maintaining a constant motive fluid source inventory (at a temperature achieved in effecting the transition from State C' to State A) within the disengaging drum that receives the liquids thus formed in total, and (2) withdrawing any surplus liquid which will be perforce, working fluid.

4. In a thermodynamic cycle having, (1) a transition of a working fluid from a State A (representing a pressure $P_1$ and a temperature $T_1$ outside a vapor/liquid phase region for the working fluid) to a State B (representing a pressure $P_2$ lower than $P_1$ and a temperature $T_2$ lower than $T_1$) and (2) a transition from a State C' (representing a pressure $P_3$ which approximates $P_1$ and a temperature $T_3$ which is intermediate to temperature $T_1$ and temperature $T_2$) to State A, wherein the improvement comprises effecting a transition of the working fluid from State B' to State C' isenthalpically by:

subjecting the working fluid to a Joule-Thompson free expansion to subcool and liquify a portion of the working fluid before the fluid undergoes a transition from State B' to State C';

absorbing into the working fluid in State B', energy provided by an incompressible motive fluid in an energized state and higher temperature than the working fluid by placing the two fluids in energy communication by educting the working fluid into the motive fluid of a jet eductor and thereby forcing the fluids, in attaining thermal equilibrium, to share their respectiv energies;

providing by recycle accumulation of liquid and/or drawing upon external sources of the motive fluid the amount of motive fluid for the energy communication, as determined by:

(1) fixing the quantity of working fluid introduced in State B', (2) prescribing the State C' for the working fluid, and (3) fixing the energized state of the motive fluid, to pressure the working fluid from State B' (representing a pressure $P_2$ lower than $P_1$ and a temperature $T_2$ lower than $T_1$ and also lower than the critical temperature of the combined motive fluid and working fluid in the proportions in which the fluids are employed) to State C' adiabatically and simultaneously subjecting the working fluid to expansion in an expansion engine to subcool and liquify the working fluid in its transition from State B' to State C' separating phases and quantities of the motive fluid from a liquid quantity or working fluid produced between State C' and State A in a disengaging drum by:

(1) maintaining a constant motive fluid source inventory (at a temperature achieved in effecting the transition from State C' to State A) within a vessel that receives the liquid thus formed in total, and (2) withdrawing any surplus liquid which will be perforce, working fluid.

5. A process for achieving a degree of irreversibility in an adiabatic compression of a working fluid (approaching isenthalpic compression) and thus achieving an increase of pressure by expenditure of work in lesser quantities than would be required to produce the temperature rise which would accompany the same pressure rise in a reversible abiabatic compression (isentropic compression) which comprises:

absorbing into the working fluid in a State B' (representing a pressure $P_2$ and a temperature $T_2$ lower than the critical temperature of a combined motive fluid and working fluid in the proportions in which the fluids are employed), energy provided by an incompressible motive fluid in an energized state and higher temperature than the working fluid by placing the two fluids in energy communication by educting the working fluid into the motive fluid of a jet eductor and thereby forcing the fluids, in attaining thermal equilibrium, to share their respective energies;

providing, by recycle accumulation of liquid and/or drawing upon external sources of the motive fluid, the amount of motive fluid for energy communication, as determined by:

(1) fixing the quantity of working fluid introduced in State B',
(2) prescribing a State C' for the working fluid, and
(3) fixing the energized state of the motive fluid, to pressure the working fluid from State B' to a State C' (representing a pressure $P_3$ higher than $P_2$ and a temperature $T_3$ higher than $T_2$ adiabatically;

energizing the motive fluid by pumping;

separating motive fluid from a liquid quantity of working fluid produced at State C' by separating phases and quantities of the fluids in a disengaging drum.

6. A process for achieving a degree of irreversibility in an adiabatic compression of a working fluid (approximately isenthalpic compression) and thus achieving an increase of pressure by expenditure of work in lesser quantities than would be required to produce the temperature rise which would accompany the same pressure rise in a reversible adiabatic compression (isentropic compression) which comprises:

subjecting the working fluid to Joule-Thompson free expansion to subcool and liquify a portion of the working fluid before the fluid undergoes a transition from State B' to State C';

absorbing into the working fluid in a State B' (representing a pressure $P_2$ and a temperature $T_2$ lower than the critical temperature of a combined motive fluid and working fluid in the proportions in which the fluids are employed), energy provided by an incompressible motive fluid in an energized state and higher temperature than the working fluid by placing the two fluids in energy communication by educting the working fluid into the motive fluid of a jet eductor and thereby forcing the fluids, in attaining thermal equilibrium, to share their respective energies;

providing, by recycle accumulation of liquid and/or drawing upon external sources of the motive fluid, the amount of motive fluid for energy communication, as determined by:
(1) fixing the quantity of working fluid introduced in State B',
(2) prescribing a State C' for the working fluid, and
(3) fixing the energized state of the motive fluid, to pressure the working fluid from State B' to a State C' (representing a pressure $P_3$ higher than $P_2$ and a temperature $T_3$ higher than $T_2$ adiabatically;

energizing the motive fluid by pumping;

separating phases and quantities of the motive fluid from a liquid quantity of working fluid produced at State C' in a disengaging drum.

7. A process for achieving a degree of irreversibility in an adiabatic compression of a working fluid (approximately isenthalpic compression) and thus achieving an increase of pressure by expenditure of work in lesser quantities than would be required to produce the temperature rise which would accompany the same pressure rise in a reversible adiabatic compression (isentropic compression) which comprises:

absorbing into the working fluid in a State B' (representing a pressure $P_2$ and a temperature $T_2$ lower than the critical temperature of a combined motive fluid and working fluid in the proportions in which the fluids are employed), energy provided by an incompressible motive fluid in an energized state and higher temperature than the working fluid by placing the two fluids in energy communication by educting the working fluid into the motive fluid of a jet eductor and thereby forcing the fluids, in attaining thermal equilibrium, to share their respective energies;

providing, by recycle accumulation of liquid and/or drawing upon external sources of the motive fluid, the amount of motive fluid for energy communication, as determined by:
(1) fixing the quantity of working fluid introduced in State B',
(2) prescribing a State C' for the working fluid, and
(3) fixing the energized state of the motive fluid, to pressure the working fluid from State B' to a State C' (representing a pressure $P_3$ higher than $P_2$ and a temperature $T_3$ higher than $T_2$ adiabatically; and simultaneously subjecting the working fluid to expansion in an expansion engine to subcool and liquify the working fluid in its transition from State B' to State C';

energizing the motive fluid by pumping;

separating phases and quantities of the motive fluid from a liquid quantity of working fluid produced at State C' in a disengaging drum.

8. A process for achieving an isenthalpic compression of a working fluid vapor from a State B' (representing a pressure $P_2$ lower than a pressure $P_1$ of a State A and a temperature $T_2$ lower than a temperature $T_1$ of State A) to a State C' (representing a pressure $P_3$ which approximates $P_1$ and a temperature $T_3$ which is intermediate to temperature $T_1$ and temperature $T_2$) by:

maintaining a constant flow of motive fluid as determined by fixing States B' and C' for the working fluid and the energized state of the motive fluid;

pumping the motive fluid to this energized state;

introducing the motive fluid to a jet eductor;

introducing the working fluid in State B' to the suction of the jet eductor to create a total effluent at State C';

maintaining a back pressure control of the total effluent of the jet eductor;

separating the total vapor as working fluid and in addition withdrawing any amount of liquid in excess of a constant inventory of liquid as working fluid liquid.

* * * * *